United States Patent [19]

Tas

[11] Patent Number: 4,583,636

[45] Date of Patent: Apr. 22, 1986

[54] DEVICE FOR WEIGHT CLASSIFICATION OF CROPS

[76] Inventor: Adrianus W. Tas, Burgemeester Winkellaan 3, 2631 HB Nootdorp, Netherlands

[21] Appl. No.: 550,077

[22] Filed: Nov. 8, 1983

[30] Foreign Application Priority Data

Nov. 9, 1982 [NL] Netherlands ..... 8204328

[51] Int. Cl.[4] ..... B07C 5/18

[52] U.S. Cl. ..... 198/504; 177/145; 198/802; 209/592

[58] Field of Search ..... 209/592, 593, 594, 595, 209/912; 198/504, 505, 365, 802; 177/52, 54, 145

[56] References Cited

U.S. PATENT DOCUMENTS

| | | | |
|---|---|---|---|
| 3,489,278 | 1/1970 | Alexander | 209/593 |
| 4,262,807 | 4/1981 | Leverett | 209/592 |
| 4,413,690 | 11/1983 | Peterson | 198/504 |

FOREIGN PATENT DOCUMENTS

| | | | |
|---|---|---|---|
| 0060013 | 9/1982 | European Pat. Off. | 209/552 |
| 7400756 | 7/1975 | Netherlands . | |
| 7701513 | 8/1978 | Netherlands . | |

*Primary Examiner*—Robert B. Reeves
*Assistant Examiner*—Donald T. Hajec
*Attorney, Agent, or Firm*—Thomas S. MacDonald; Alan H. MacPherson; Steven F. Caserza

[57] ABSTRACT

A device for weight classification of crops comprising and endless conveying member, pick-up members for the products to be weight pivotally coupled with the conveying member and a mechanism for assessing the weight of the products located in and/or on the pick-up members, whereby a pick-up member is pivoted with the aid of a first pivotal shaft to a tie member, which is coupled with the aid of a second pivotal shaft extending at least substantially parallel to the first pivotal shaft with the endless conveying member in a manner such that the center of the pick-up member is located between the two pivotal shafts.

5 Claims, 2 Drawing Figures

DEVICE FOR WEIGHT CLASSIFICATION OF CROPS

FIELD OF THE INVENTION

The invention relates to a device for weight classification of crops comprising an endless conveying member, pick-up members pivoted to said conveying member for picking up the products to be weighed and mechanism for assessing the weight of the product lying in and/or on the pick-up member.

Prior Art

In such devices, which may furthermore be designed to classify the products not only according to weight but also to colour, the pick-up member is frequently coupled with the conveying member with the aid of a single pivotal shaft located at a relatively large distance from the centre of the pick-up member. Variations in the location of the centre of gravity of the product to be weighed with respect to the pivotal shaft may effect the measurements carried out to a great extent.

This is in the first place inconvenient because as a result a weighed object may be classified in an incorrect weight class.

A much more important disadvantage of this known construction may be due to the fact that in such known devices the weights of the products supplied to a given grading compartment or to a trough or the like disposed at this grading compartment are added to assess the total amount of products supplied to the grading compartment or collecting trough or the like concerned. It will be obvious that incorrect measurements of the weight may result in considerable differences from the wanted, overall weight of a quantity supplied to a collecting trough, for example, an auction crate or the like.

SUMMARY OF THE INVENTION

According to the invention the pick-up member is pivoted with the aid of a first pivotal shaft to a tie member, which is coupled with the aid of a second pivotal shaft extending at least substantially parallel to the first pivotal shaft with the endless conveying member in a manner such that the centre of the pick-up member is located between the two pivotal shafts.

When using such a construction variations in the location of the centre of gravity of the product to be sized with respect to the pivotal shafts will hardly affect the weighing effect and in practice it has been found that by using the construction embodying the invention an appreciably greater accuracy in weighing can be obtained than by the known constructions.

The invention will be described more fully hereinafter with reference to an embodiment of the construction in accordance with the invention schematically shown in the accompanying Figures.

DETAILED DESCRIPTION

Figure 1:
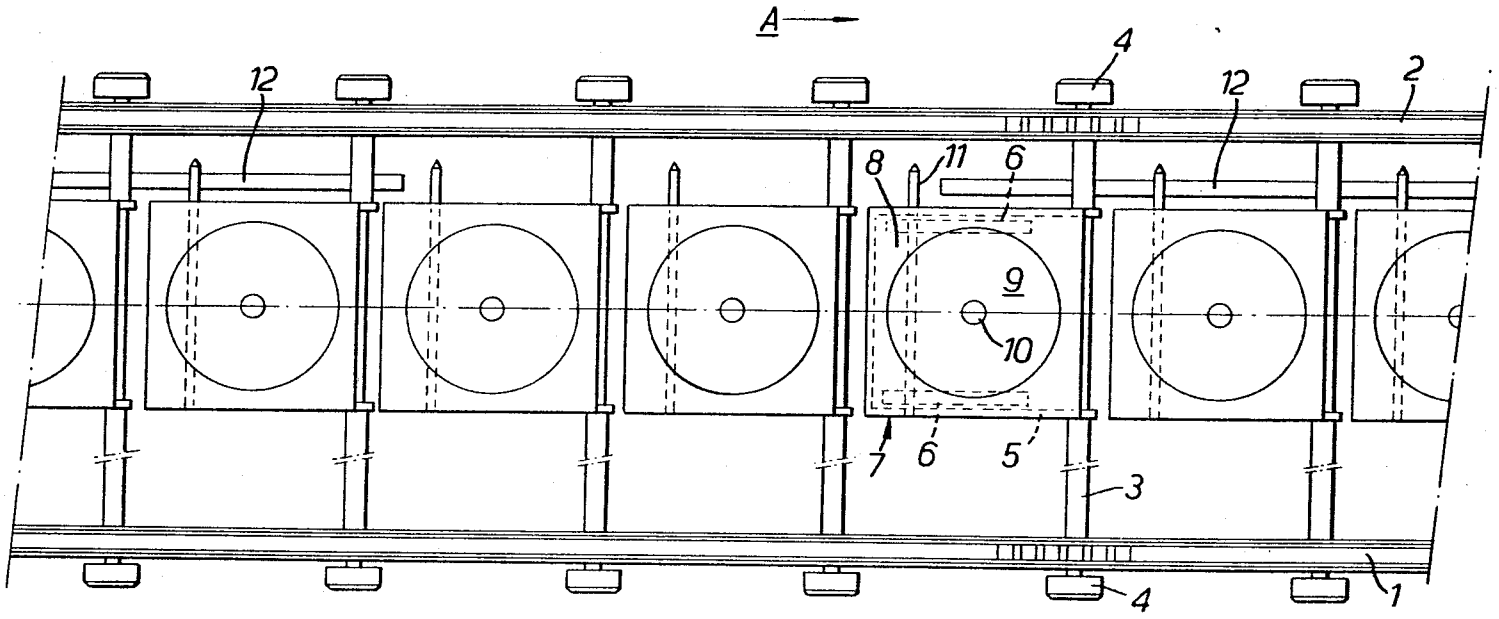
FIG. 1 is a schematic plan view of part of an endless conveying member of a device embodying the invention.

Referring to the Figures, the endless conveying member comprises two endless, relatively parallel chains 1 and 2, in which shafts 3 extending at right angles to the direction of length of the chains are journalled at equal intervals. The ends of the shafts 3 are provided with rollers 4 for guiding the endless conveying member in frame parts (not shown) of the grading device.

During operation the chains 1 and 2 and the parts connected therewith are displaced in the direction of the arrow A.

To each shaft or pin 3 is pivoted a U-shaped bracket 5 by passing the shaft 3 through bores in the free ends of the limbs of the bracket. The disposition is such that the limbs of the brackets extend opposite the intended direction of displacement indicated by the arrow A away from the shaft 3 concerned toward the web interconnecting the limbs.

Between the limbs of each bracket 5 are arranged two ridges 6 extending parallel to said limbs and forming part of a pick-up member 7. The top rims of the ridges 6 are fastened to a plate 8 which is at least substantially at right angles to said ridges and has a central, cup-shaped part 9, at the centre of which a hole 10 is provided. Each pick-up member 7 is pivoted to the bracket 5 with the aid of a pivotal shaft 11 extending parallel to the shafts 3 and being passed through holes in the limbs of the bracket 5 and in the ridges 6.

Along a large part of the trajectory of the pick-up members 7 moving with the chains 1 and 2 ends of the pins 11 protruding from the brackets 5 are guided along strips 12, which prevent the pick-up members from deflecting in an undesirable manner. These protruding pins 11 furthermore co-operate with members (not shown) enabling at a given instant a tilting movement of a pick-up member containing a product in order to deliver the product after measurement, as the case may be after testing its colour at a given place as described, for example, in Dutch Patent Application Nos. 7400756 and 7701513 the disclosures of which are herein incorporated by reference.

From the Figures it will furthermore be apparent that the centre of the pick-up member, in particular, the centre of the cup-shaped part 9 is located between the two pivotal shafts 3 and 11 viewed in a direction at right angles to the plane going through the said two pivotal shafts of the pick-up member concerned. The width of the plate-shaped part 8 of the pick-up member 7 is larger than the distance between the proximal sides of the limbs of the bracket 5 so that the plate 8 and the bracket 5 co-operate in order to prevent the pick-up members, in their position shown in Figures in the upper run of the endless conveying member, from turning beyond a given angle about the pivotal shafts 11 with respect to the brackets 5.

Figure 2:
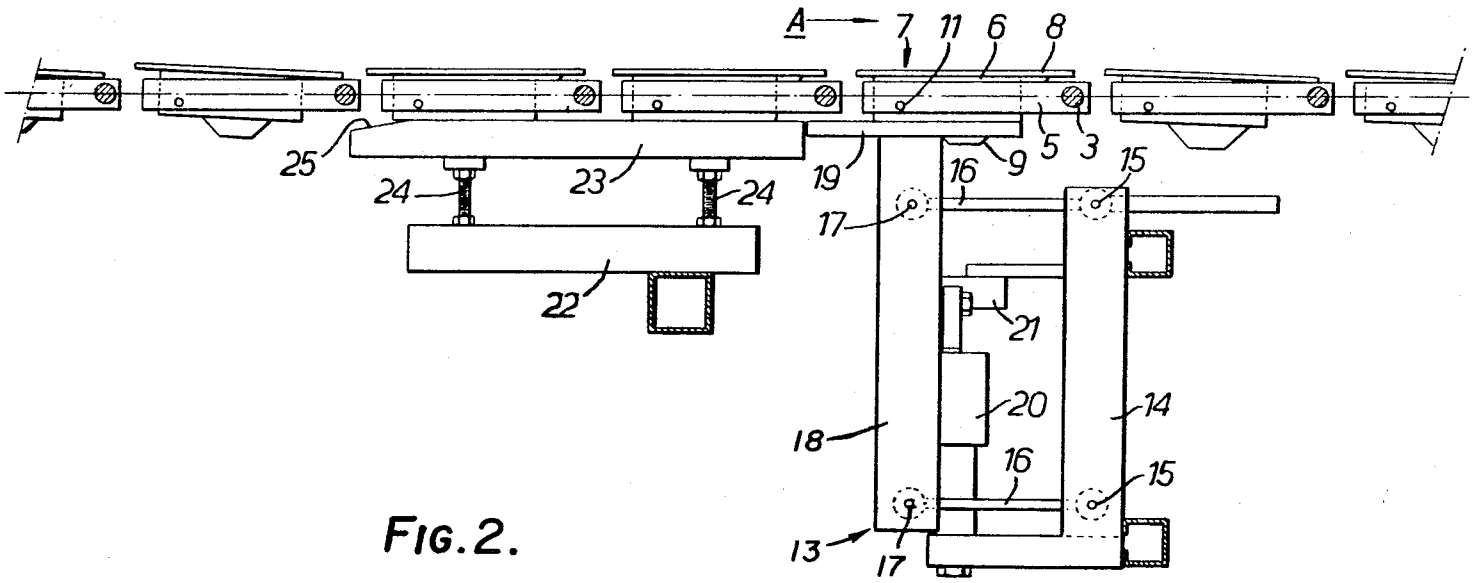
FIG. 2 is partly a sectional view and partly a side elevation of the conveying member in FIG. 1 with a weighing mechanism.

The grading device is furthermore provided FIG. 2 with a weighing mechanism 13 comprising fixed, vertical beams 14. With the aid of horizontal shafts 15 the ends of arms 16 are pivoted to said beams 14. The ends of the arms 16 remote from the beams 14 are pivotally coupled with the aid of shafts 17 extending parallel to the shafts 15 with a carrier 18 supporting at the top end a weighing platform 19. The carrier 18 is coupled with a shock absorber 20 and a pressure sensor 21. With the aid of this pressure sensor signals can be transmitted in dependence of the weight supported by the weighing platform 19 and exerting a downward force on the supporting member 18.

In front of the weighing platform a guide plate 23 is arranged for the pick-up members 7. This guide plate 23 is adjustable in a direction of height by means of set bolts 24 with respect to a stationary frame part 22. Viewed in the intended direction of displacement indicated by the arrow A the front end of the guide plate 20 has an inclined ramp 25.

The products to be weighed, as viewed in FIG. 2, are deposited in the pick-up members 7 at a given place to the left of the weighing member 13 and the guide plate 23. During the displacement of these pick-up members in the direction of the arrow A with the aid of the chains 1 and 2 the pick-up members will arrive at a given instant at the level of the guide plate 23, along which move the undersides of the ridges 6. The guide plate 23 is provided to move the undersides of the ridges 6 to become coplanar with the top side of the weighing platform 19. At the level of the guide plate 23 and the weighing platform 19 the ends of the pins 11 protruding from the brackets 5 are free of guide members. The pick-up members 7 aligned with the aid of the guide plate 23 slide from the guide plate 23 into the weighing platform 19, where the weight of a product contained in the pick-up member concerned is assessed by means of the weighing unit 13 and transmitted to ensure that the product is delivered at the correct place.

Owing to the mode of suspension described above for the pick-up member with the aid of two relatively spaced pivotal shafts variations in the locations of the centres of gravity of the products in the pick-up members will substantially not affect the measurement of the weight.

The figures used are only meant to explain more clearly the intention of the invention and are not supposed to be any restriction concerning the interpretation of the invention.

I claim:

1. A device for weight classification of products comprising:

an endless conveying member;

a series of pick-up members, each including a product-holding plate, pivotally affixed to said conveying member;

a series of parallel first pivotal shafts each connected to and extending transversely across said conveying member;

bracket means pivotally attached to each of said first pivotal shafts and extending under said plate of each of said pick-up members for supporting an underside of said plate;

weighing means including a weighing platform positioned below said conveying member, each of said pick-up members being movable by said conveying member in succession to coplanarly abut a top side of said weighing platform;

a pair of ridge members affixed to and extending downward from said plate to periodically engage said weighing platform; and a series of parallel second pivotal shafts each extending transversely across one of said bracket means and pivotally coupled to said ridge members such that said plates may pivot relative to said bracket means;

said plates, first pivotal shafts, bracket means, ridge members, and second pivotal shafts being arranged such that a center of each particular pick-up member is between those first and second pivotal shafts extending transversely across that particular pick-up member.

2. A device as set forth in claim 1 wherein said bracket means is a U-shaped bracket having two legs supporting side underedges of said plate.

3. A device as set forth in claim 1 wherein said series of parallel second pivotal shafts extending transversely across said bracket means continue beyond said bracket means such that they operate to tilt said pick-up members in order to remove said products from said plate.

4. A device as set forth in claim 1 further including guide means positioned below said conveying member and vertically aligned with and positioned upstream of said weighing platform for guiding an underside of said ridge members into a coplanar position with said weighing platform to align said pick-up members with said weighing platform.

5. A device as set forth in claim 4 wherein said guide means includes an upstream ramp portion which engages said ridge members into said coplanar position.

* * * * *